US006038714A

United States Patent [19]

Guenther

[11] Patent Number: 6,038,714

[45] Date of Patent: Mar. 21, 2000

[54] CONCEALED GRAB BAR

[75] Inventor: Torbett B. Guenther, 8992 Tamarack Ct., Plymouth, Mich. 48170

[73] Assignees: Torbett B. Guenther; Dolores Guenther, both of Plymouth, Mich.

[21] Appl. No.: 09/199,519

[22] Filed: Nov. 25, 1998

[51] Int. Cl.[7] ..... A47K 3/024

[52] U.S. Cl. ..... 4/576.1; 4/571.1

[58] Field of Search ..... 4/576.1, 573.1, 4/571.1, 559, 577.1; 16/110 R, 111 R, 114 R

[56] References Cited

U.S. PATENT DOCUMENTS

| | | | |
|---|---|---|---|
| 2,242,461 | 5/1941 | Fisher . | |
| 2,319,017 | 5/1943 | Tillman . | |
| 2,694,813 | 11/1954 | Cartwright et al. | 4/576.1 |
| 2,815,513 | 12/1957 | Tilson et al. . | |
| 2,885,690 | 5/1959 | Scott . | |
| 3,098,240 | 7/1963 | Fleenor . | |
| 3,140,496 | 7/1964 | Thompson . | |
| 5,050,252 | 9/1991 | Cuttris . | |
| 5,307,528 | 5/1994 | Nieuwenhuis et al. . | |

FOREIGN PATENT DOCUMENTS

| | | | |
|---|---|---|---|
| 943137 | 11/1963 | United Kingdom | 4/576.1 |

*Primary Examiner*—David J. Walczak
*Attorney, Agent, or Firm*—Reising, Ethington, Barnes, Kisselle, Learman & McCulloch PC

[57] ABSTRACT

A grab assembly includes a grab bar and a mounting flange for each end of the grab bar. Each mounting flange has an annular projection. The ends of the grab bar extend into and are secured to the projections. An annular cover is sleeved over the projection of each mounting flange to conceal the flange with a tight fit so that there is no gap. The invention is also applicable to a center support for the grab bar.

15 Claims, 2 Drawing Sheets

CONCEALED GRAB BAR

This invention relates generally to wall-mounted bars, and more particularly to a grab bar which is adapted to be mounted adjacent to a toilet or tub, for example, to assist handicapped or elderly persons.

BACKGROUND AND SUMMARY OF THE INVENTION

Grab bars typically have a mounting flange at each end, to mount the grab bar on a wall surface or the like. Covers received on the grab bar are provided to conceal the two mounting flanges. The covers must be loosely received on the grab bar so that they may travel freely over the grab bar surface towards positions overlying and concealing the flanges. Because of this looseness, a gap must exist between the bar and each cover. This gap is objectionable and detracts from the overall appearance of the grab bar assembly.

The purpose of the present invention is to eliminate this gap. The grab bar assembly of the present invention has a mounting flange at each end, but each flange has an annular projection. The ends of the grab bar extend into the annular projections and are secured thereto. The covers are sleeved over the projections and are constructed to have a tight fit therewith. Therefore, there is no gap. The grab bar is an elongated member preferably of uniform diameter throughout its length. The projection on the flange at each end of the grab bar has an outside diameter greater than that of the grab bar. The cover has an inside diameter corresponding with the outside diameter of the projection. This provides a tight a fit, preferably an interference fit. The cover while it fits tightly around the projection and thus eliminates the gap, is of larger diameter than the grab bar so that the cover can move along the grab bar to its final assembled position without scratching or marring the grab bar.

Preferably the annular projection is U-shaped in cross section having a radially inner ring in which an end of the grab bar is secured and a radially outer ring with which the cover has a tight fit. This invention is also applicable to an intermediate support for the grab bar. The support has a mounting flange provided with an annular projection. The cover has a tight fit on the projection. The cover has a larger inside diameter than the diameter of the support so that the cover, when lifted away from the projection, may be tilted and shifted to one side, providing ready access to fasteners used in mounting the flange on a wall surface.

One object of this invention is to provide a grab bar assembly having the foregoing features and capabilities.

Another object is to provide a grab bar assembly which is constructed of a few simple parts, is rugged and durable in use, and is inexpensive to manufacture and easy to install.

These and other objects, features and advantages of the invention will become more apparent as the following description proceeds, especially when considered with the accompanying drawings.

DETAILED DESCRIPTION OF THE PREFERRED EMBODIMENTS

Figure 1:
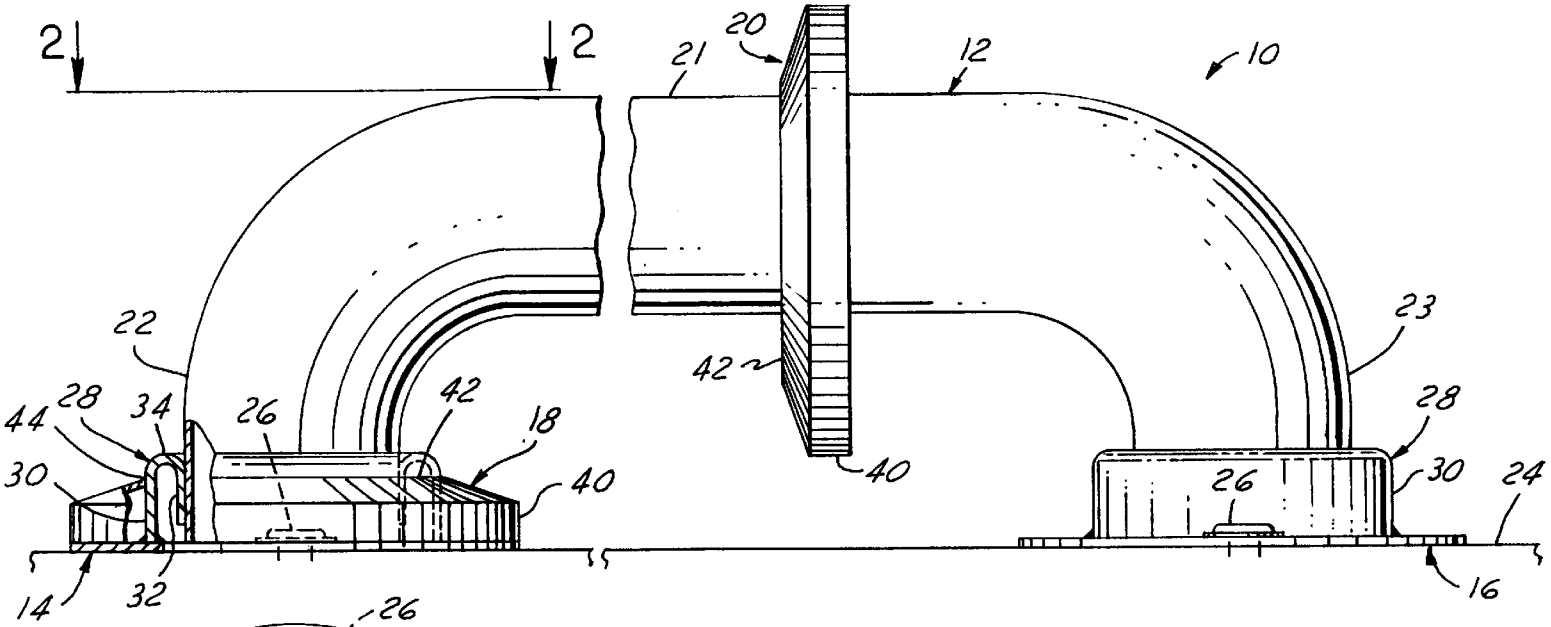
FIG. 1 is an elevational view with parts in section showing a grab bar assembly constructed in accordance with the invention. One of the covers is shown in its final assembled position concealing a mounting flange. The other cover is shown displaced from its final position.
Figure 2:
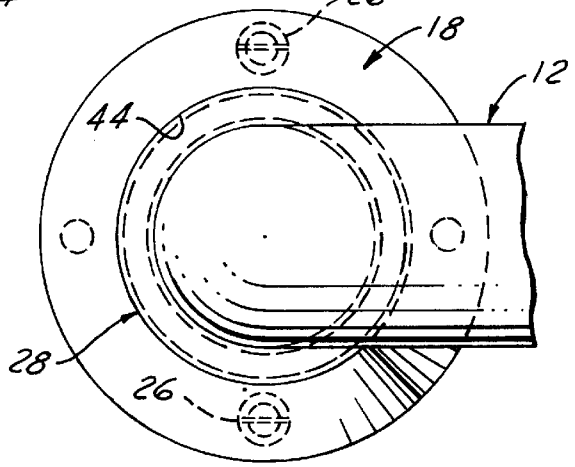
FIG. 2 is a fragmentary view taken on the line 2—2 in FIG. 1.

Referring now more particularly to the drawings and especially to FIGS. 1 and 2, the grab bar assembly 10 includes an elongated grab bar 12 having mounting flanges 14 and 16 at the two ends, a cover 18 for the mounting flange 14 and a cover 20 for the mounting flange 16.

The grab bar 12 has a straight cylindrical central portion 21 curving into end portions 22 and 23 extending perpendicular to the central portion. The grab bar is of uniform diameter from end to end.

The mounting flanges 14 and 16 are identical. Each mounting flange is flat and is secured to a wall surface 24 by fasteners 26. Each mounting flange has an annular projection 28 extending axially from one side thereof. The projection 28 is U-shaped in cross section, having a radially outer cylindrical ring 30 and a radially inner cylindrical ring 32. The outer ring 30 of the projection has its axially inner edge welded or otherwise permanently secured to the flange 14 or 16 and extends perpendicular to the plane of the flange. The inner ring 32 of the projection is of smaller diameter than the outer ring and also extends perpendicular to the plane of the flange. The inner and outer rings 30 and 32 of the projection are integrally connected at the axially outer ends thereof by a curved base section 34.

Each end of the grab bar 12 extends into the annular projection of one of the mounting flanges 14, 16. Each end of the grab bar has the same outside diameter as the inside diameter of the inner ring of the projection and is secured as by welding in surface-to-surface contact therewith.

The covers 18 and 20 are identical. Each cover is cup-shaped having a circular radially outer rim portion 40 of approximately the same diameter as the outer edge of the flange. The rim 40 is shown resting on the outer edge portion of the flange 14, but could be larger in diameter so as to overlap the outer edge of the flange. The cover has a base 42 with a circular hole 44 in the center. The diameter of the hole 44 is substantially the same as the outside diameter of the outer ring 30 of the projection. The cover is sleeved over and fits tightly on the outer ring of the projection as shown in FIG. 1 with the edge of the hole engaging the ring 30. There is no gap between the cover and the projection because of the tight fit. Preferably the fit is an interference fit.

The cover 20 is shown displaced from its final position. The diameter of the hole 44 in the cover is substantially greater than the diameter of the grab bar so that the cover may be moved freely along the length of the grab bar to its final position covering a mounting flange and fitting on the projection 28 of the mounting flange, without marring or scraping the surface of the grab bar.

Figure 3:
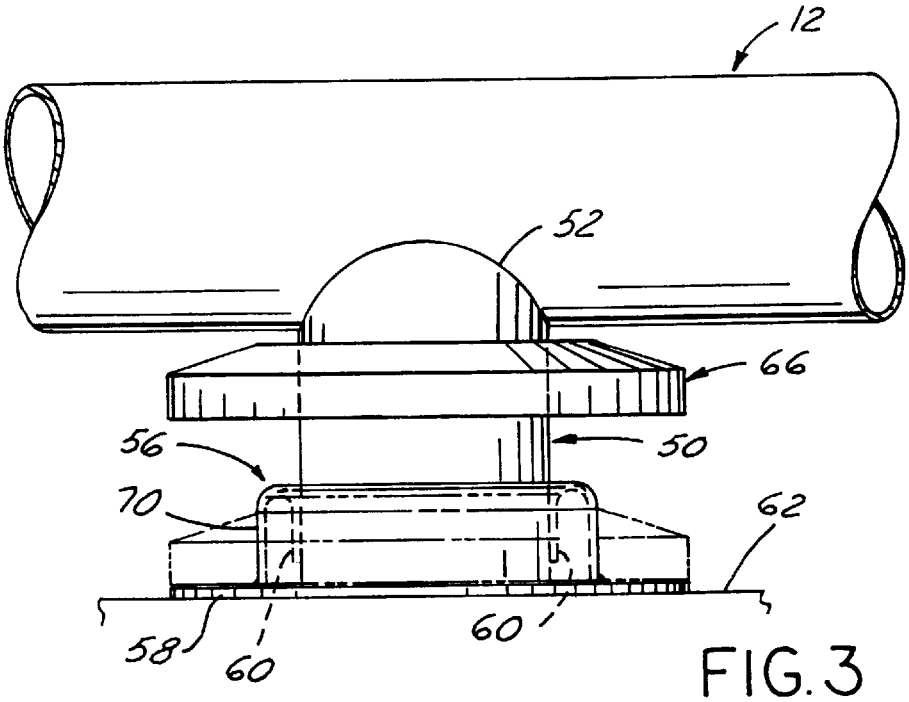
FIG. 3 is a fragmentary elevational view showing an intermediate support for a grab bar, constructed in accordance with the invention. The cover is shown in broken lines in its final assembled position and in solid lines displaced from its final position.
Figure 4:
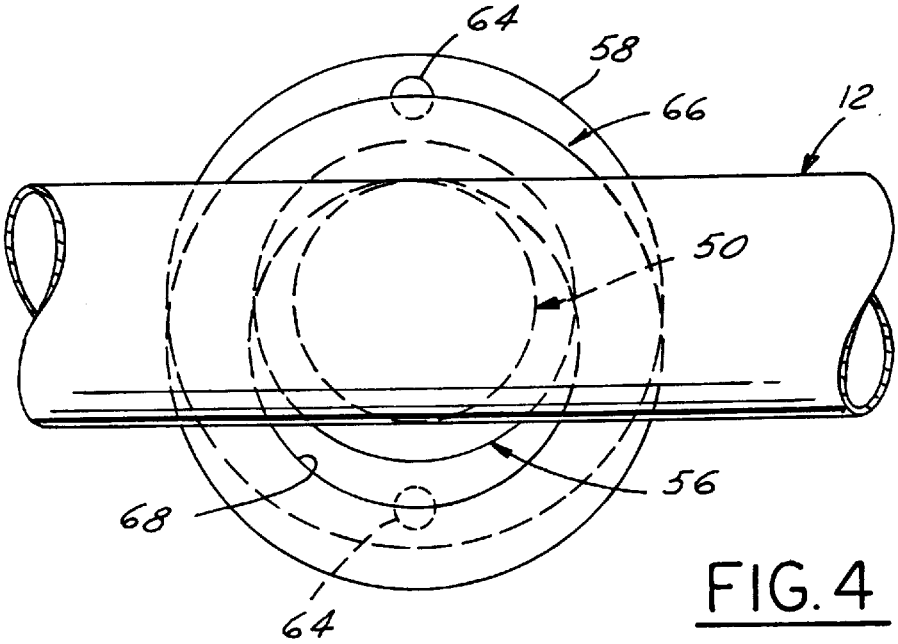
FIG. 4 is a view of the structure shown in FIG. 3 as seen from above.

A modification of the invention is shown in FIGS. 3 and 4. The grab bar 12 shown in FIGS. 3 and 4 may be identical to the grab bar in FIGS. 1 and 2 and its ends may have mounting flanges and covers (not shown) exactly as shown in FIGS. 1 and 2. FIGS. 3 and 4 show a center support 50 for the grab bar, which is adapted to engage and support the grab bar at any point along its length.

The support 50 is in the form of a short cylindrical rod having a saddle 52 at the outer end which may have a concave recess corresponding in diameter to that of the grab bar to receive and support the grab bar as best shown in FIG. 3. The lower end of the support 50 extends into the projection 56 of the mounting flange 58. The mounting flange 58 and projection 56 may be identical to the mounting flange and projection shown in FIGS. 1 and 2. The inner end of the support 50 is secured as by welding to the inner ring 60 of the projection in the same manner that an end of the grab bar is secured to the inner ring of the projection of the flange in FIG. 1. The flange 58 is secured to a wall surface 62 by fasteners 64.

The cover 66 shown in FIGS. 3 and 4 may be identical to the covers shown in FIGS. 1 and 2. The central hole 68 in the cover is of a diameter substantially larger than the diameter of the support 50 so that the cover may be shifted to one side and tilted as in FIG. 4 to provide access to the fasteners 64 whereby the fasteners may be conveniently applied without interference from the cover. After the mounting flange 58 is attached to the wall surface 62 by the fasteners 64, the cover may be moved to its assembled position shown in broken lines in FIG. 3 in which the central hole thereof has a tight fit, preferably an interference fit, with the outer ring 70 of the projection.

What is claimed is:

1. A grab bar assembly comprising a grab bar, a mounting flange adapted to be secured to a mounting surface and having an annular projection extending axially outwardly from one side thereof, said grab bar having an end extending into said annular projection and secured thereto, and an annular cover having an inside diameter providing a loose clearance fit of said cover on said grab bar in pre-assembly therewith and in final assembly with said flange being sleeved over said projection to conceal said flange, said cover having a tight fit with said projection, said loose fit of said cover with said grab bar thereby enabling said cover to be tilted and laterally shifted relative to said grab bar when free of being sleeved over said projection and while said grab bar is secured to said projection.

2. A grab bar assembly according to claim 1, wherein said grab bar is an elongated member of uniform diameter throughout its length, said projection has an outside diameter greater than that of said grab bar, and said cover has an inside diameter corresponding with the outside diameter of said projection.

3. A grab bar assembly according to claim 2, wherein said cover has an interference fit with said projection.

4. A grab bar assembly according to claim 2, wherein said annular projection has a radially inner surface to which said end of the bar is secured and a radially outer surface with which said cover has the said tight fit.

5. A grab bar assembly according to claim 2, wherein said annular projection is generally U-shaped in cross-section having a radially inner ring to which said end of said bar is secured and a radially outer ring with which said cover has said tight fit.

6. A grab bar assembly according to claim 5, wherein said cover has an interference fit with said outer ring.

7. A grab assembly comprising, an elongated grab bar having first and second ends and being of uniform diameter from end to end, first and second mounting flanges each having an annular projection extending axially outwardly from one side thereof, said projections each having an outside diameter greater than that of said grab bar, and first and second annular covers having an inside diameter providing a loose clearance fit of said cover on said grab bar and in final assembly respectively sleeved over the associated projections of the respective first and second flanges to conceal said flanges, said covers each having an inside diameter corresponding to the outside diameter of the associated one of said projections to provide a tight fit with said associated one of said projections, said loose fit of said cover with said grab bar thereby enabling each said cover to be tilted and shifted laterally relative to said grab bar when free of being sleeved over the associated said projection and while said grab bar is secured to said projection.

8. A grab bar assembly according to claim 7, wherein each said annular projection is generally U-shaped in cross-section having a radially inner ring to which said end of said bar is secured and a radially outer ring with which said cover has said tight fit.

9. A grab bar assembly according to claim 8, wherein each of said covers has an interference fit with the associated projection.

10. A grab bar assembly comprising, a grab bar, a mounting flange adapted to be secured to a mounting surface and having an annular projection extending axially outwardly from one side thereof, a support for said grab bar extending into said annular projection and secured thereto, and an annular cover having an inside diameter providing a loose clearance fit of said cover on said support and in final assembly sleeved over said projection to conceal said flange, said cover having a tight fit with said projection, said loose fit of said cover with said support thereby enabling said cover to be tilted and shifted laterally relative to said support when free of being sleeved over said projection and while said support is secured to said projection.

11. A grab bar assembly according to claim 10, wherein said annular projection is generally U-shaped in cross-section having a radially inner ring to which said support is secured and a radially outer ring with which said cover has said tight fit.

12. A grab bar assembly according to claim 11, wherein said grab bar is an elongated member having an integral end constituting the support for said grab bar.

13. A grab bar assembly according to claim 12, wherein said cover has an interference fit with said outer ring.

14. A grab bar assembly according to claim 11, wherein said grab bar is an elongated member and said support is separate from said grab bar and adapted to engage and support said grab bar at an intermediate point in its length.

15. A grab bar assembly according to claim 14, wherein said cover has an interference fit with said outer ring.

* * * * *